United States Patent [19]

Fichte et al.

[11] 4,021,710

[45] May 3, 1977

[54] SPEED CONTROL SYSTEM FOR A CONTINUOUSLY OPERATING SHEET FEEDER

[75] Inventors: Frank Fichte, Taucha; Wolfgang Paul, Leipzig, both of Germany

[73] Assignee: VEB Polygraph Leipzig Kombinat fur Polygraphische Maschinen und Ausrustungen, Leipzig, Germany

[22] Filed: Mar. 27, 1975

[21] Appl. No.: 562,427

[30] Foreign Application Priority Data

Mar. 28, 1974 Germany ..... 177504

[52] U.S. Cl. ..... 318/39; 318/571; 271/159; 214/8.5 A

[51] Int. Cl.[2] ..... G05B 19/24

[58] Field of Search ..... 271/159; 318/163, 571, 318/39; 214/8.5 A

[56] References Cited

UNITED STATES PATENTS 2,734,744 2/1976 Backhouse ..... 271/159

*Primary Examiner*—B. Dobeck

*Attorney, Agent, or Firm*—Michael J. Striker

[57] ABSTRACT

The stack of sheets is moved towards the distributor at a control velocity corresponding to the distributor operation. If the stack in the operative vicinity of the distributor becomes too low, indicating too slow a stack advance, a mechanical sensor sensing the position of the top of the stack rotates to a position interrupting the signal furnished by the first and second inductive input signal generator. The interruption of the signal results in the furnishing of a second sensor output signal which, at a time determined by a synchronizing signal sets a monostable multivibrator whose output then energizes a relay which in turn applies voltage to a winding of a servomotor moving the arm of a potentiometer in a direction for increasing the speed of advance of the stack. Similarly, when the stack is too high, neither of the signals from the inductive generators is interrupted and a third sensor output signal generated in response to the presence of the two signals similarly causes the servomotor to drive the potentiometer in the opposite direction thereby retarding the speed of transport of the support means carrying the stack. Since the feeder system has first and second support means so that sheets are continuously available to the distributor means, the system also comprises a number of control switches and an additional sensor for connecting the different support means to corresponding motors and for switching the first support means from an induction motor effecting a rapid transport to a DC motor effecting the controlled transport when the stack is within a predetermined distance of the distributor means.

16 Claims, 13 Drawing Figures

SPEED CONTROL SYSTEM FOR A CONTINUOUSLY OPERATING SHEET FEEDER

BACKGROUND OF THE INVENTION

The present invention relates to sheet feeder systems and more particularly to those systems wherein the stack of sheets is continuously supplied to the distributor so that the arrangement can operate continuously. The present invention is particularly advantageous when utilized for the control of the transport of large flat sheets.

It is particularly important in such arrangements that, after the introduction of a new stack into the system, the stack is moved rapidly into the operative vicinity of the distributor and that the distributor can operate continuously to separate the sheets from the stack and to transport the individual sheets towards the next processing station.

In known arrangements of the above-described type, pawl drive mechanisms are utilized and the stack is transported step-by-step in synchronism with the operation of the remainder of the machine. The drive mechanisms is subject to such great wear at higher machine outputs that breakage can result. Further, with this type of drive, only constant lifting intervals can be realized and thus, depending upon the mechanical layout, only a limited number of sheets can be processed per interval.

In order to overcome this disadvantage, further known systems replace the step-by-step operating mechanical drive by electric motors which also operate step-by-step. In such motors it is possible to create varying intervals by the use of timing elements. However, these electromotor drives also have disadvantages. First of all, under high output conditions and particularly when processing a sheet load approaching the maximum possible for the set interval, the motors are often overloaded which causes the windings to burn out. This of course limits the maximum possible output. Further, the systems have the disadvantage that the cycle is initiated by a single signal furnished by a microswitch or similar means. Thus an automatic control under changing conditions is impossible and the contact wear limits the reliability of the arrangement and severely limits the maximum possible switching frequency.

The above-described systems can be found in patents BRD-AS1,102,770 and 1,118,812 of the German Democratic Republic.

Further, in the publication BRD-AS 1,217,406, transport systems for sheet feeder arrangements are known which utilize either contactless or contact sensors to furnish the signals for causing a change in the position of the stack. This can result in a continuous transport system. However, these systems have various disadvantages when large size sheets are being processed. First, the density of the stack at different places differs and the top surface of the stack is also quite variable.

For this reason contactless sensors as, for example, described in BRD-AS 1,189,088, have heretofore only been used to control the movement of the support means for the stack, such as a table, in the downward direction, that is away from the distributor means in order to receive a new stack. A further disadvantage of the contactless sensor systems is that the tight tolerances which are required in defining the operative vicinity to the distributor means cannot be maintained by such sensors. However, the system using contact-type sensors which allow the maintenance of these tolerances have other disadvantages. These systems again operate mainly with microswitches which, as previously mentioned, results in high contact wear and therefore a limiting of the possible switching frequency, a lack of reliability and a relatively short lifetime for the system.

Further arrangements for positioning the stack are shown, for example in BRD-AS 1,263,028, wherein the drive is continuously adjustable and wherein the position of the individual sheet is sensed in a contactless manner either photoelectrically or inductively, and control members for regulating the transport speed of the stack are operated in response to these sensors. The control members may be control transformers, resistors, magnetic amplifiers or thyritron amplifiers or even controllable silicon rectifyers. For universally applicable stack feeds for flat sheets, which may reach relatively large sizes, these control members are not usable since they are operative only for low power outputs and have a poor efficiency when high power outputs are required. Specifically for a constant torque, only a small region of adjustment is available. However, particularly for sheet feeder arrangements of the above-described type and utilizing broad sheets varying in thickness from paper to cardboard, a large adjustment region is required.

SUMMARY OF THE INVENTION

It is an object of the present invention to overcome the disadvantages of the present state of the art while maintaining the advantages of the above-described systems.

It is an object of the present invention to furnish a transport system for a stack of sheets which, after it has received said stack and following the receipt of a start signal will, in correspondence to each possible operating speed of the distributor and independent of the thickness of the individual sheets to be separated by the distributor, operate automatically in such a manner that the top surface of the stack will remain within operative vicinity of the distributor at all times.

The present invention is a sheet feeder system receiving stacks of sheets and having transport means for continuously transporting said stack, at a speed varying in response to a speed control signal, towards distributor means for distributing said sheets. It comprises sensor means mounted in proximity to said distributor means for sensing the position of the top of said stack and furnishing a first sensor output signal when said position is correct, a second sensor output signal when said position is too low and a third sensor output signal when said position is too high relative to said distributor means. The invention further comprises first means for furnishing a desired speed signal corresponding at least in part to the speed of operation of said distributor means. It further comprises control means connected to said sensor means and said first means for furnishing said speed control signal to said transport means in response to said desired speed signal and the then present one of said sensor output signals.

In a preferred embodiment of the present invention, synchronizing signal means are furnished which furnish synchronizing signals for synchronizing the operation of the control means to the operation of the distributor means. Logic circuit means combine the sensor output signals with the synchronizing signals thereby furnishing timed synchronizing signals. The timed synchronizing signals are in turn applied to interval timing means which furnish extended sensor output signals for a predetermined time interval if either the second or the third sensor output signal is present. The extended sensor output signals each activate a relay which connects the winding of a servomotor in a first or second polarity to a source of voltage. The servomotor is coupled to the variable arm of a potentiometer. The setting of the potentiometer originally depends upon the thickness of the sheets being processed. The potentiometer is connected to the output winding of a tachogenerator (first means) which furnish the above-mentioned desired speed signal. The signal furnished by the combination of the output winding of the tachogenerator and the potentiometer is applied to a thyristor control circuit which furnishes the speed control signal at its output. The speed control signal is applied either to a first DC motor which is coupled to first support means for the stack or to the second DC motor which is coupled to the second support means for the stack which take over from the first support means when the stack has been decreased by a given amount so that the first support means can return to the initial position to receive a second stack.

In a further preferred embodiment of the present invention, the sensor means comprises a mechanical member coupled to the mounting of a blower element which is part of the distributor. Depending upon the height of the top surface of the stack, as determined by the sensorblower, the member interrupts one or both of the signals furnished by inductive signal generators.

A light sensor is mounted on the walls of the arrangement which furnishes the signals for an electrically controlled multiple clutch to switch the drive system from an induction motor which drives at a rapid speed to a DC motor which operates under the controlled speed. Further, a contact is mounted on the sidewall of the system which is activated when the opening in second support means is plugged, thereby allowing the second support means to carry the stack while the first support means returns for a new stack. A DC motor also drives the second support means under control of the speed control signal. The present invention thus results in a completely automatic regulation of the stack transport and allows a very narrow tolerance region relative to the distributor means to be maintained. The arrangement of the present invention can operate in conjunction with a known and reliable continuously operating transport means which includes first and second support means as will be described in greater detail below. Use of the thyristor control circuit further allows a high power output and high efficiency.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
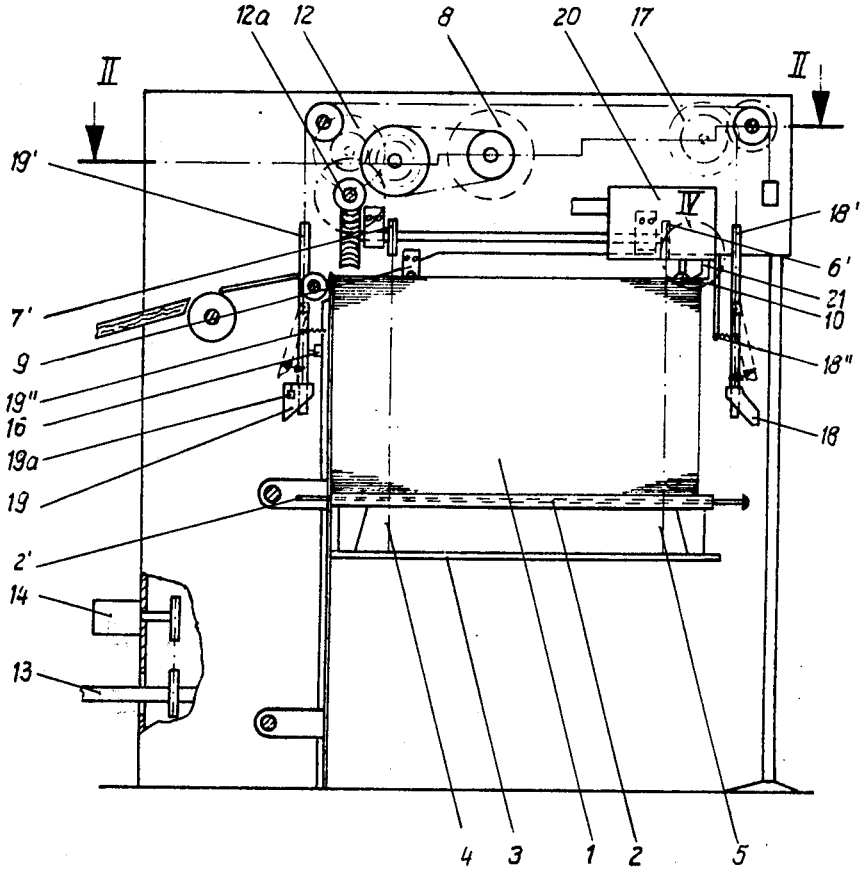
FIG. 1 is a sectional side view of a sheet feeder arrangement.

A preferred embodiment of the present invention will now be described with reference to the drawing.

As shown in FIG. 1, the stack 1 is received in the sheet feeder system via a pallet 2 on a plate 3. Plate 3 constitutes the first support means and is moved by means of chains 4, 5, 6 and 7 and associated sprocket wheels 4′, 5′, 6′ and 7′. The driving of the sprocket wheels takes place as follows: An induction motor 8, which in a preferred embodiment of the present invention is a squirrel cage motor, lifts the stack from its initial position to a second predetermined position in which the top surface of the stack is within a predetermined distance from the distributor means. Specifically, an automatic switching takes place which interrupts the rapid transport as soon as the top surface of the stack is within operative vicinity of nozzles 10. This is determined by a pulse from an optical sensor 9. The pulse from optical sensor 9 is also used to activate an electrically activated multiple clutch 11 to disconnect motor 8. Further, coupling 11 now couples DC motor 12 to the drive shaft 12*a*. When driven by motor 12, the velocity of transport of the stack is determined as a function of the rotational speed of a shaft 13 (FIG. 1) which drives a tachogenerator 14. The shaft 13 is driven at a speed corresponding to the speed of the distributor means and the output voltage of generator 14 thus constitutes a desired speed signal.

A contact 16 is mounted on the side wall of the housing of the system. This is connected to a DC motor 17 which constitutes second moving means for moving the second support means. It should be noted that in the known apparatus in which the present invention is utilized, the pallet has a number of grooves each of which carries a rod. These rods are designated by reference numeral 2′ and can be seen more clearly in FIGS. 1*a*–1*e*. The second support means comprise guide rails 18 and 19, situated, as reference to FIG. 1 will show along the path of the stack but separated by a sufficiently great distance to allow passage of the stack therebetween. As the pallet with rods 2′ rides over rails 18 and 19 and articulated guide rails 18′, 19′, these rails are pushed apart. After the rods have passed over the rails, springs 18″ and 19″ return the articulated guide rails 18′ and 19′ to their previous position. It should be noted that the guide rails constitute second support means which have an opening which is closed when the rods are inserted so that the remainder of the stack is now supported on the top of the rods.

Figure 1A:
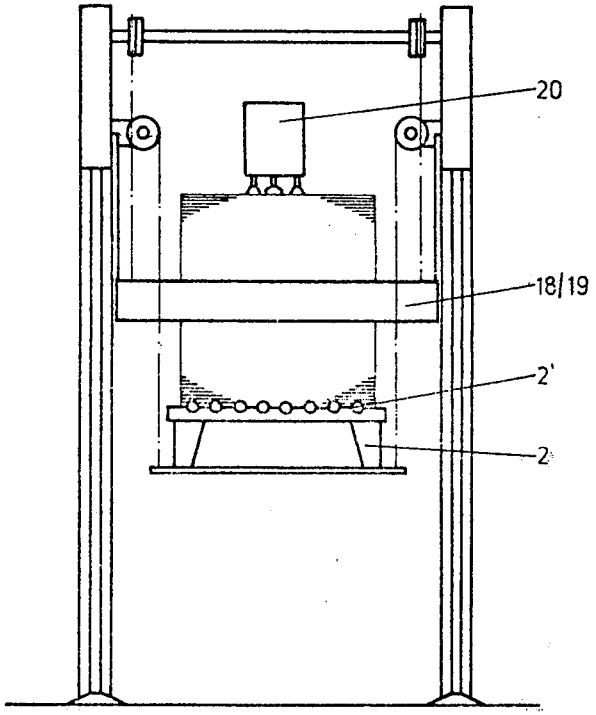
FIGS. 1*a*–1*e* are simplified views of the sheet feeder arrangement during various parts of the operating cycle.
Figure 1B:
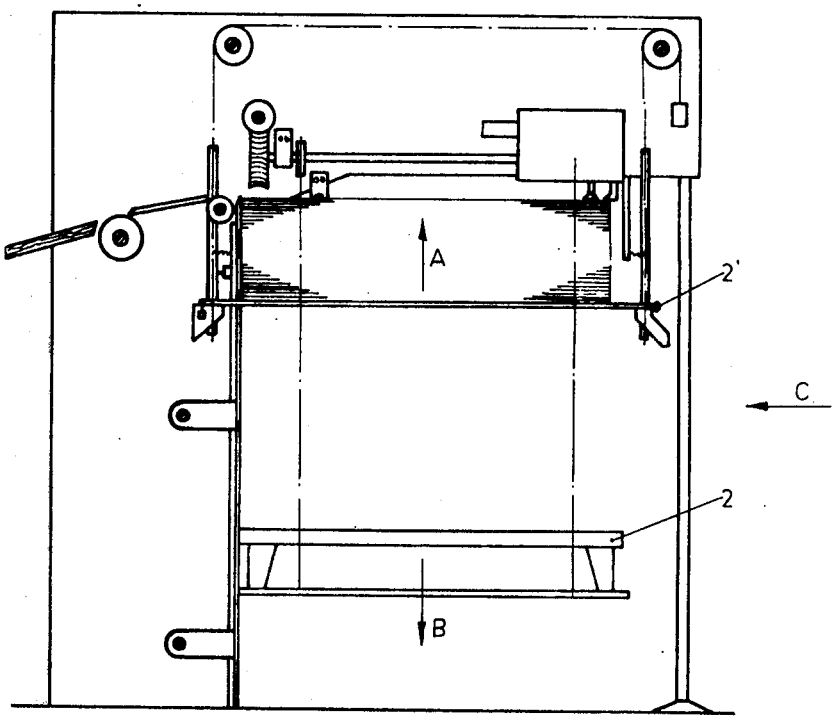
Figure 1C:
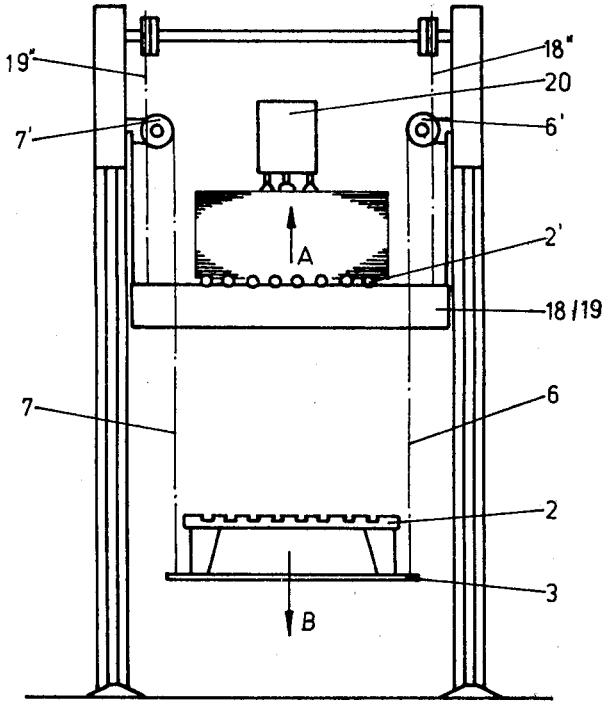

The above will be described in greater detail with reference to FIGS. 1*a*–1*e*. Specifically FIG. 1*a* shows a side view of the apparatus shown in FIG. 1, and at the same point in the operating cycle of FIG. 1. The stack is here still supported by the first support means, namely pallet 2. As shown in FIG. 1*b*, the rods have been fixed between rails 18 and 19 so that the second support means are now moving upward with the remainder of the stack while the first support means move downwards in the direction of the arrow B to receive the next-following stack. FIG. 1*c* shows a side view in the direction of arrow C in FIG. 1*b*. It is seen clearly how the remainder of the stack is supported by rods 2' which in turn are supported by the rails 18 and 19. Rails 18 and 19 are moved via chains 18'' and 19'' in direction of arrow A. This view clearly shows the grooves in pallet 2 into which the rods 2' will again be inserted later.

Figure 1D:
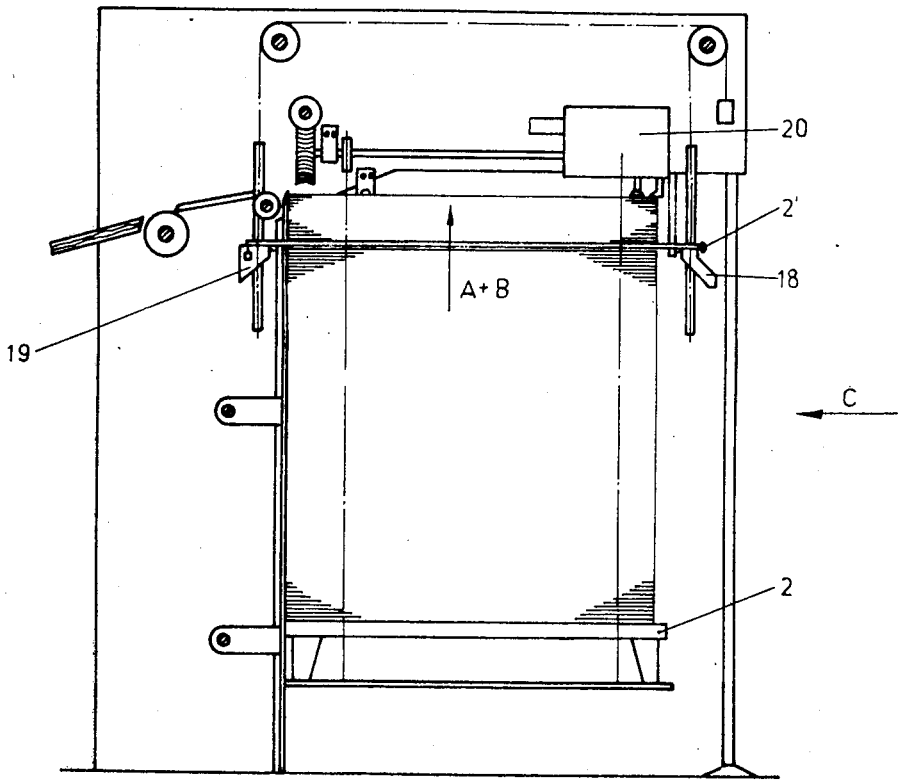

FIG. 1*d* again shows a side view of the feeder. After the new stack had been inserted, this is brought rapidly upwards until the top of the stack meets the rods 2'. The view shown in FIG. 1*d* shows the view at the time at which the newly brought-up stack is almost in contact with the bottom of the old stack but prior to the time that the rods 2' have been removed and the guide rails 18 and 19 have been lowered.

Figure 1E:
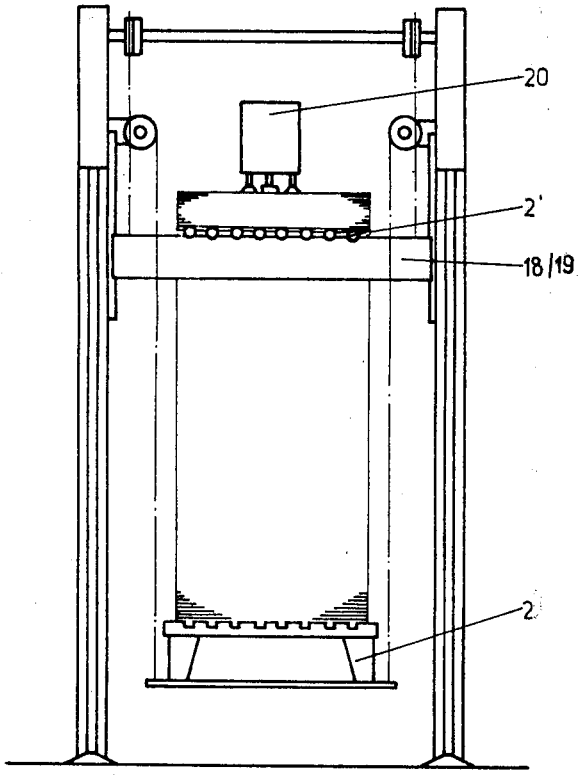
Figure 2:
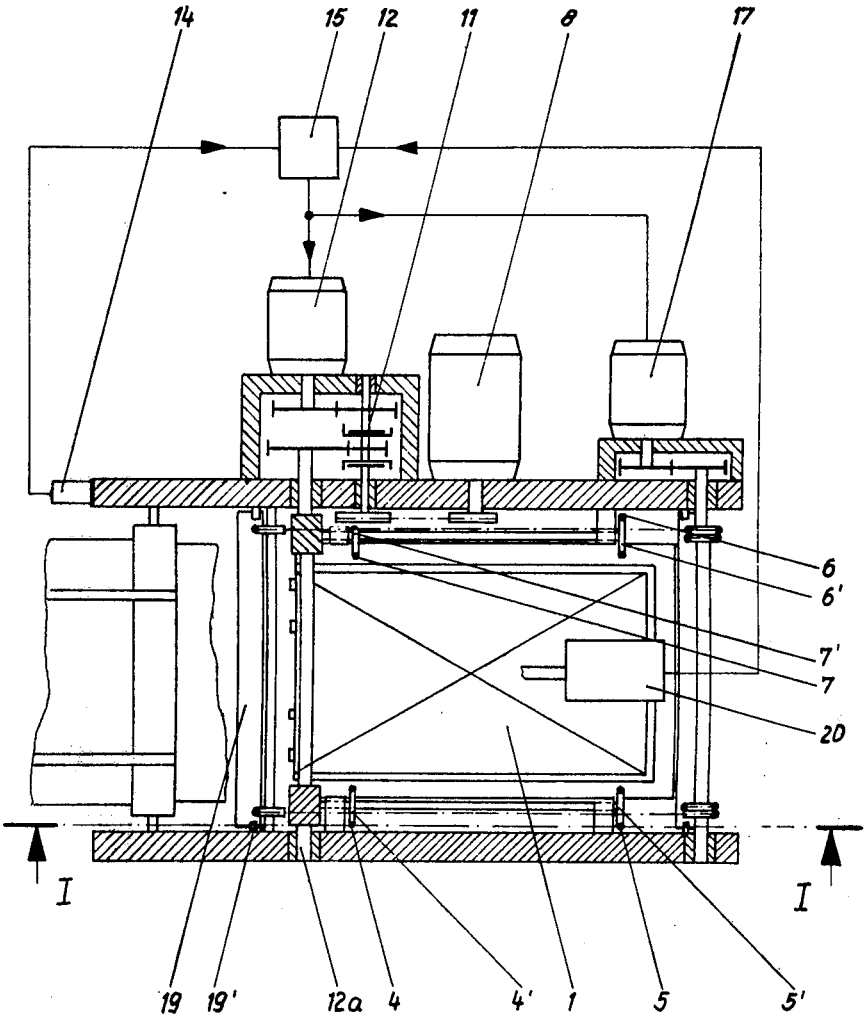
FIG. 2 is a sectional top view along section designated by lines II—II in FIG. 1.

FIG. 1*e* is again a view in the direction of arrow C of FIG. 1*d*. It is clear that rods 2' may be removed after stacks A and B have been joined, that is after both stacks are supported by the first support means, namely pallet 2. After removal, the rods are later reinserted into the grooves in pallet 2 so that, after the rods again pass rails 18 and 19, the second support means again moves the remainder of the stack towards the distributor means.

The above-described transport system is a known system and is described herein only to clarify the operation of the moving control means associated therewith.

To return to FIG. 1, a contact 6 is mounted on the walls of the housing of the feeder system such that it is activated when the guide rails 19' return to their original position under the action of spring 19''. At this point of course rails 18 and 19 lie underneath rods 2'. First, motor 17, which is activated by the signal furnished by contact 16, lifts rails 18 and 19 via a known chain drive at a maximum velocity. As soon as guide rails 18 and 19 are loaded by rods 2', a contact **19*a* is activated by means of rail 19 which causes the maximum velocity of motor 17 to be interrupted. Motor 17 now transports the stack with the same velocity with which it was previously transported since the signal of contact 19*a* is also used to disconnect motor 12, to activate coupling 11 and to switch in motor 8 for lowering plate 3 and pallet 2 at a high velocity. The downward movement of plate 3 is stopped by means of an end switch which is activated when plate 3** reaches the bottom. Meanwhile, the remainder, of the stack as supported by the rods and rails is maintained with a top surface in the vicinity of the distributor means.

After receipt of a new stack 1 and a manually energized rapid transport as described above, the load from rails 18 and 19 is removed when the top of the new stack comes in contact with the bottom of the remainder of the old stack. At this point contact **19*a* causes motor 17 to be disconnected and coupling 11 to switch in such a manner that DC motor 12 again resumes control of the transport. Simultaneously, induction motor 8 is disconnected. While motor 12 operates to continue the transport of the stack, the guide rails are returned to their original position at maximum velocity by means of motor 17**. Thus the top surface of the stack, if a new stack is introduced at the correct time, will always by within operative proximity of the distributor causing an uniterrupted supply of sheets to be furnished by the distributor.

Figure 4C:
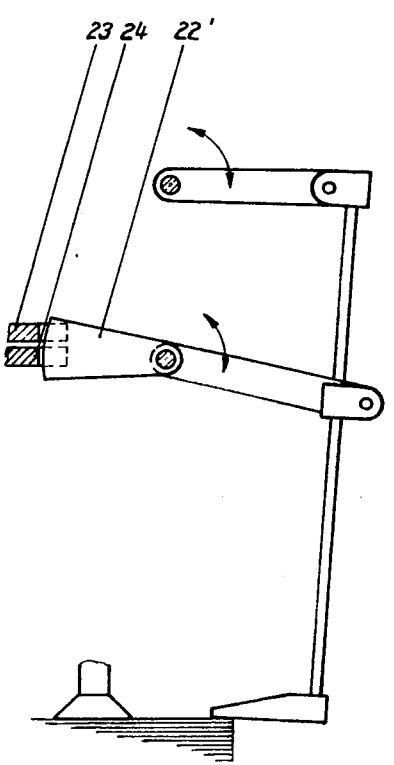
FIGS. 4*a*–4*c* show the sensor means in greater detail.

The desired speed signal furnished to thyristor control circuit 15 is derived as follows: A sensor control circuit 15 is derived as follows: A sensor blower 21 which is part of the sheet separator 20 touches the top surface of the stack after each sheet has been removed. A mechanical member 22 is fastened to blower 21 (see FIGS. 4*a*–4*c*). The member 22 moves in or below the operative region of two inductive signal generators 23 and 24. Signal generators 23 and 24 for example each comprise a coil into which a voltage is induced by the signal generator. These coils may be arranged one on top of each other or side-by-side, but in the latter case two members 22 must be furnished. It should be noted that member 22, when in the region between the output coils of the signal generators and the signal force, interrupts the flow of flux to the coils and therefore interrupts the signal furnished by the coils. These signals are herein referred to as first and second input signals. As shown in FIG. 5, the signals furnished by generators 23 and 24 are applied to terminals $y_1$, $y_2$; and $y_3$, $y_4$ respectively. The output signal of generator 23 is applied to a threshold circuit 25 while that from generator 24 is applied to a threshold circuit 26. Since generators 23 and 24 are separated by a predetermined distance, three different signal combinations can occur. If the mechanical member is in the position shown in FIG. 4*a*, that is in the position indicating too high a stack, neither of the signals from generators 23 and 24 is interrupted. Therefore, threshold circuits 25 and 26 each furnish a signal. If however member 22 is in the position shown in FIG. 4*b* only the threshold circuit 25 will furnish a signal while, if the sensor is in the position shown in FIG. 4*c*, neither of these threshold circuits 25 and 26 will furnish a signal. For the position shown in FIG. 4*b*, the stack is of course at the correct height, while in the position shown in FIG. 4*c*, the top surface of the stack is too low indicating that an increase in stack transport velocity is required.

Also shown in FIG. 5 is a shift register 27 which furnishes synchronizing signals for synchronizing the control circuit shown in FIG. 5 with the operation of the distributor. If both threshold circuits furnish a 1 output signal, AND-gate 28 will furnish a 1 output signal upon receipt of a signal from shift register 27. After amplification in amplifier 29 the output signal of AND-gate 28 will switch a bistable circuit 30 to a first stable state wherein, after amplification in an amplifier 31 it energizes a relay 32 whose contacts 32' deenergize the motor and cause the transport of the stack to be stopped. Further, the output signal from AND-gate 28 is also applied to the set input of a monostable multivibrator 33 which furnishes an output signal for a time duration determined by its time constant to an amplifier 34 and then to a relay 35. The contacts of relay 35 close for a time period determined by the time constant of monostable multivibrator 33 and, during this time, connect the windings of a servomotor 36 to a source of electrical energy in such a manner that the motor is energized to rotate in a first direction (See also FIG. 3)

Figure 4B:
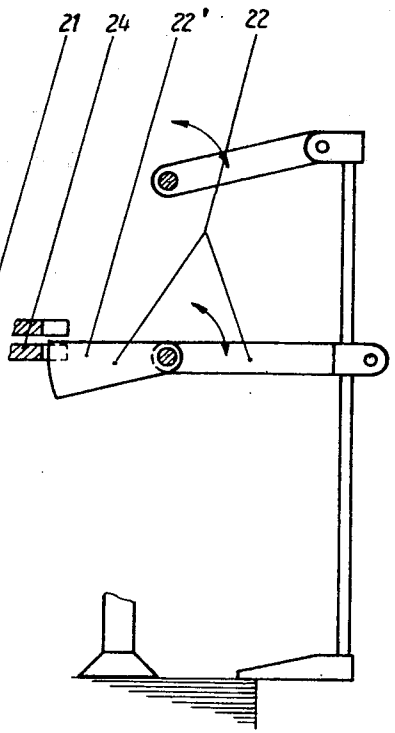
Figure 4A:
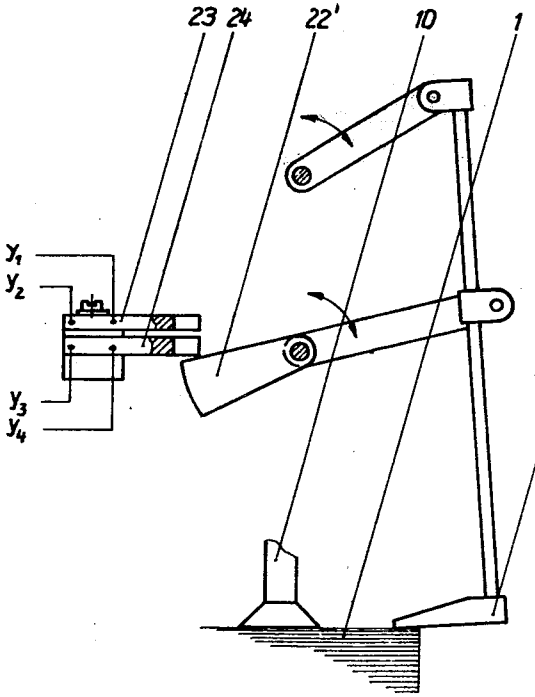
Figure 5:
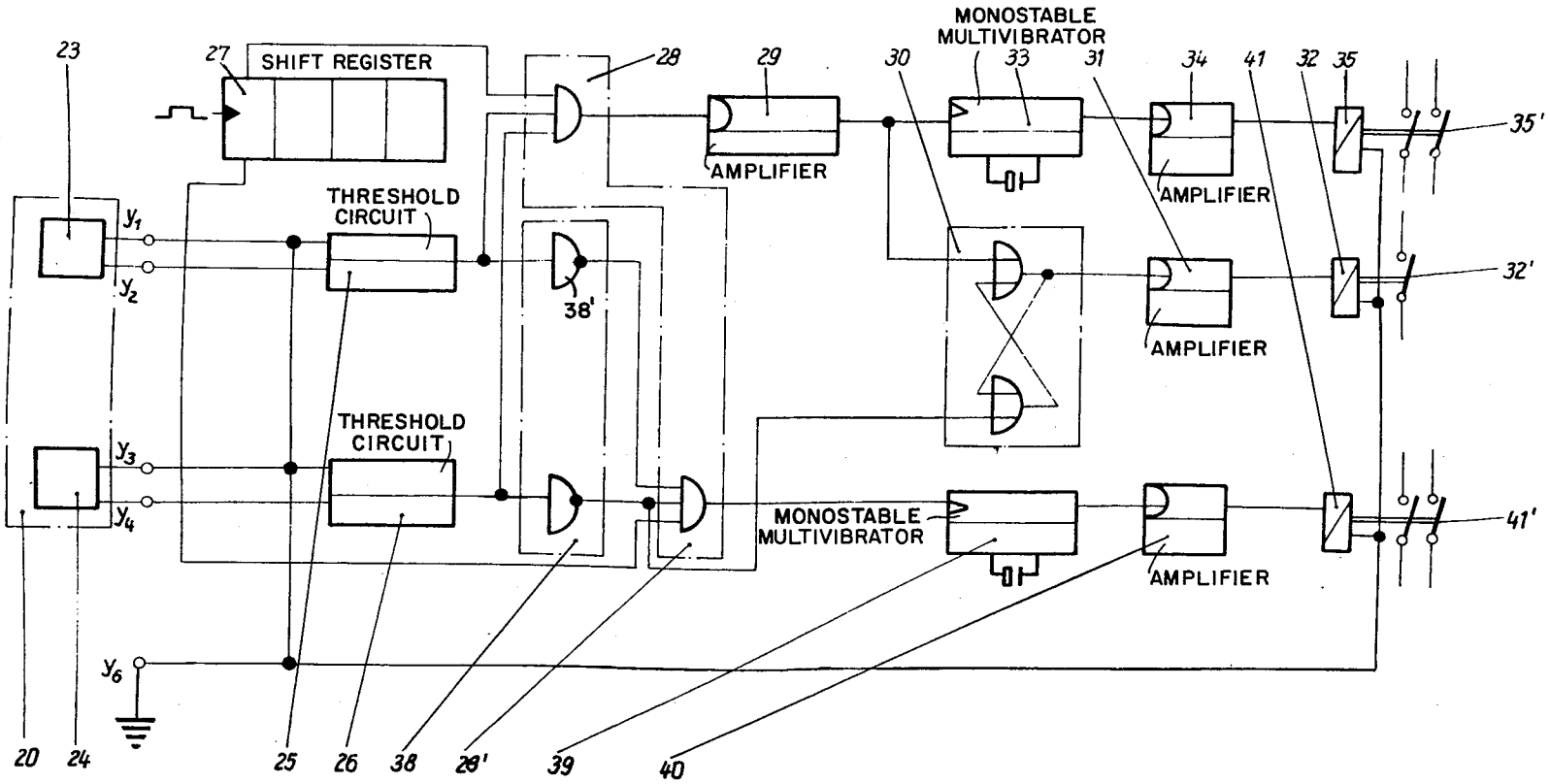
FIG. 5 is a block diagram showing the logic circuit processing the signals generated in FIGS. 4*a*–4*c*.

If the sensor position thereafter returns to the position shown in FIG. 4*b*, only generator 23 will furnish an output signal. The absence of an output signal at threshold circuit 26 blocks AND-gate 28 and further causes a signal to be applied to one input of AND-gate 28' through inverter 38. The output signal of inverter 38 is applied to the second input of bistable circuit means 30 so that relay 32 is deenergized allowing the transport of the stack to continue. AND-gate 28' is of course still blocked because of the absence of a signal at the output of the second inverter 38' connected to the output of threshold circuit 25.

In the event that the motor transport is too slow, inverter 38' will also furnish a signal so that AND-gate 28' becomes conductive upon receipt of a synchronizing signal from shift register 27. The output of AND-gate 28' causes monostable multivibrator 39 to switch to the unstable state wherein it furnishes an output signal to an amplifier 40 which in turn energizes a relay 41. Energization of relay 41 causes closing of contacts 41' which, as reference to FIG. 3 will show, connect the control winding of servometer 36 to the source of electrical energy with the polarity opposite to that achieved by the closing of contacts 35'. Servomotor 36 moves the variable arm of its potentiometer 37 in a direction designed to increase the desired speed signal. This continues until the sensor returns to the position shown in FIG. 4*b*.

Figure 3:
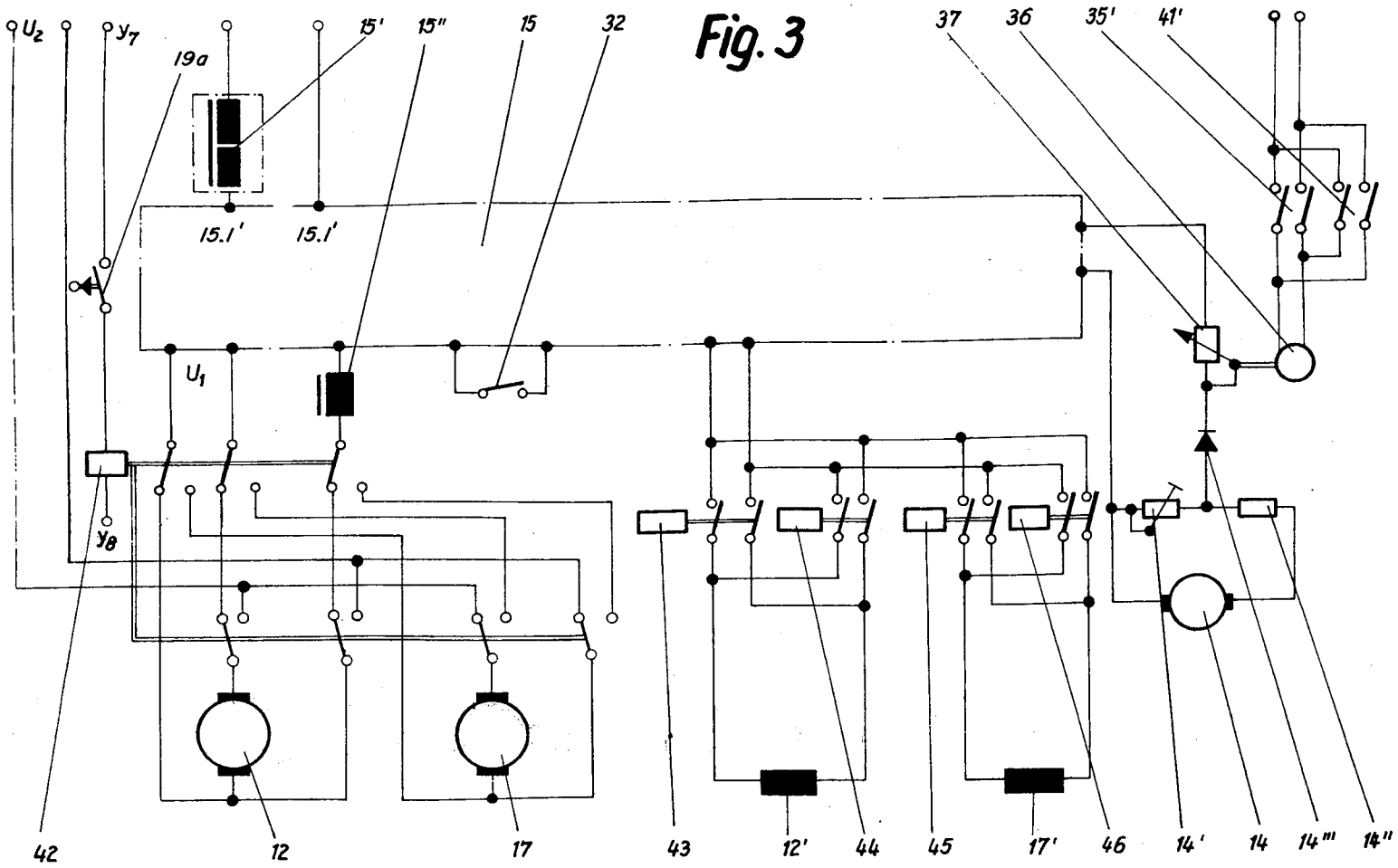
FIG. 3 shows the switching arrangement for the motor windings.

As shown in FIG. 3, the voltage across the potentiometer 37 is combined with the voltage furnished by generator 14 through a resistance network including resistors 14' and 14'' and through a diode 14''' and the resulting voltage is applied to thyristor control circuit 15 to constitute the desired speed signal.

Figure 6:
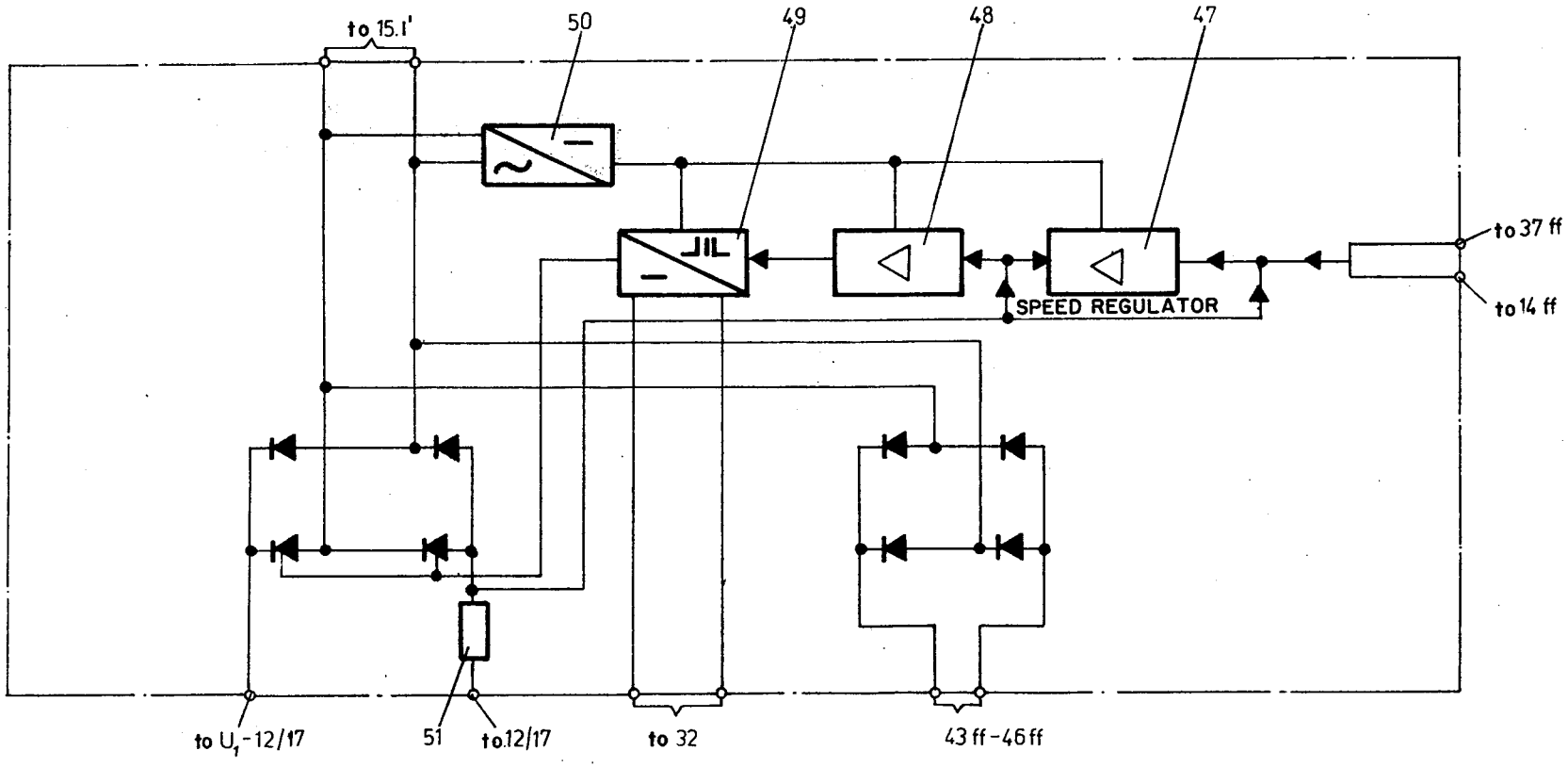
FIG. 6 is a more detailed diagram of the thyristor contron circuit utilized in FIG. 3.

FIG. 6 is a more detailed diagram of the thyristor control circuit shown as a block in FIG. 3. It should be noted that this is a commerically available unit and its description is included here only for generalized understanding. The desired speed signal furnished by generator 14 and potentiometer 37 of FIG. 3 is applied to the circuit at terminals labelled 37*ff* and 14*ff*. This is connected to the input of a speed regulator 47. At this point the desired speed signal is compared to an actual speed signal derived from a tachometer or indirectly via the induced voltage in the armature. The difference between the desired and actual signals are amplified in speed regulator 47 and furnish a desired value signal for the auxiliary control variable, namely the armature current. Adjustment of potentiometer 7 allows continuous adjustment of the desired current value from zero to a value corresponding to the rated value of the thyristor rectifiers.

The desired current signal furnished by unit 47 is compared to an actual current signal, namely the voltage drop across a resistor 51 by means of current regulator 48. Of course a current transformer could replace resistor 51. The output signal from current controller 48 serves as the input signal to the final output stage 49. In stage 49, a sawtooth voltage synchronized to line voltage and having a frequency of 120Hz is generated. This sawtooth voltage is compared with the output from stage 48. If the voltage at the comparator output is positive, ignition pulses are furnished by a blocking oscillator. These ignition pulses are separated into two channels, amplified, and applied to the ignition electrodes of the thyristor. By splitting the 120Hz frequency ignition pulse sequence into two channels, the ignition pulses are applied to the thyristors only at a time when the thyristors are in conductive state. Relay 32 allows the output voltage of the thyristor rectifiers to be set to zero, independent of the desired value furnished to the regulators 47 and 48. The thyristor circuit is energized through voltage applied at terminals 15.1' through a protective coil 15' shown in FIG. 3.

While the invention has been illustrated and described as embodied in a specific type of control circuitry, it is not intended to be limited to the details shown, since various modifications and circuit changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a sheet feeder system having distributor means for distributing sheets for processing and having transport means for receiving a stack of sheets and continuously transporting said stack at a speed varying in response to a control signal to said distributor means, a control system for furnishing said control signal comprising, in combination, sensor means mounted in proximity to said distributor means for sensing the position of the top of said stack and furnishing a first sensor output signal when said top of said stack is correctly positioned relative to said sensor means, a second output signal when said position of said top of said stack is too low, and a third output signal when said position of said top of said stack is too high relative to said sensor means; first means for furnishing a desired speed signal which varies in dependence upon the speed of operation of said distributor means; and control means connected to said first means, said sensor means and said transport means for furnishing said control signal to said transport means in dependence upon said desired speed signal and the then present one of said first, second and third sensor output signals.

2. A system as set forth in claim 1, wherein said sensor means comprises a feeler resting on top of said stack, first and second signal furnishing means mounted in a first and second predetermined position relative to said feeler for furnishing a first and second input signal respectively, and disrupt means mechanically coupled to said feeler for movement therewith and mounted relative to said first and second input signal furnishing means in such a manner that said disrupt means interrupts the furnishing of said first, of both, or of neither of said input signal furnishing means in dependence upon the position of said top of said stack.

3. A system as set forth in claim 2, wherein said disrupt means interrupt said signal from said first signal furnishing means only when said top of said stack is correctly positioned, interrupt the furnishing of said first and second input signal when said top of said stack is too low relative to said distributor means and permit the furnishing of both said first and said second input signal when said stack is too high.

4. A system as set forth in claim 1, wherein said transport means comprise first support means for supporting said stack, first moving means for moving said first support means and therefore said stack along a predetermined path towards said distributor means, second support means positioned along said predetermined path and having an opening for permitting passage of said stack, means for blocking said opening when the bottom of said stack has passed said second support means, second moving means for moving said second support means along a predetermined path towards said distributor means, and switch means mounted along said predetermined path of said first support means and mounted in said second support means for jointly controlling the application of said speed control signal to the operative one of said first or second moving means.

5. In a sheet feeder system having distributor means for distributing sheets for processing and having transport means for receiving a stack of sheets and continuously transporting said stack at a speed varying in response to a control signal to said distributor means, a control system for furnishing said control signal comprising, in combination, sensor means mounted in proximity to said distributor means for sensing the position of the top of said stack and furnishing a first sensor output signal when said top of said stack is correctly positioned relative to said sensor means, a second output signal when said position of said top of said stack is too low, and a third output signal when said position of said top of said stack is too high relative to said sensor means; first means for furnishing a desired speed signal corresponding at least in part to the speed of operation of said distributor means; and control means connected to said first means, said sensor means and said transport means for furnishing said control signal to said transport means in dependence upon said desired speed signal and the then present one of said first, second and third sensor output signals, further comprising synchronizing signal furnishing means for furnishing synchronizing signals for synchronizing the operation of said control means to the operation of said distributor means, and logic circuit means connected to said sensor means and said synchronizing signal furnishing means for furnishing a timed second sensor output signal in the presence of said second sensor output signal and one of said synchronizing signals, and a timed third sensor output signal in response to said third sensor output signal and one of said synchronizing signals.

6. A system as set forth in claim 5, wherein said logic circuit means comprise first and second AND-gate means each having a first input connected to said synchronizing signal furnishing means, said first AND-gate means having a second input connected to said sensor means to receive said second sensor output signal and an AND-gate output for furnishing said timed second sensor output signal, said second AND-gate means having a second input connected to said sensor means to receive said third sensor output signal and a second AND-gate output for furnishing said timed third sensor output signal.

7. A system as set forth in claim 6, further comprising a bistable logic circuit having a first stable state furnishing a stop signal for deenergizing said transport means and a second stable state in response to a signal at a first and second input respectively, means for connecting said first input of said bistable logic circuit to said second AND-gate output and means for connecting said second input to said bistable logic circuit to said sensor means to receive said first sensor output signal.

8. A system as set forth in claim 5, further comprising first and second interval timing means connected to said logic circuit means for receiving said timed second and timed third sensor output signals and furnishing a second and third extended sensor output signal, respectively, in response thereto.

9. A system as set forth in claim 8, wherein said first and second interval timing means comprise a first and second monostable multivibrator respectively.

10. A system as set forth in claim 8, wherein said control means comprise variable impedance means connected to said first means, said variable impedance means having an impedance corresponding to the thickness of said sheets, and impedance varying means coupled to said variable impedance means for varying the impedance thereof in response to said second and third extended sensor output signals.

11. A system as set forth in claim 10, wherein said variable impedance means comprise a potentiometer having a variable arm; and wherein said impedance varying means comprise a servomotor coupled to said variable arm for moving said variable arm in a first or second direction in response to said second and third extended sensor output signals respectively.

12. In a sheet feeder system having distributor means for distributing sheets for processing and having transport means for receiving a stack of sheets and continuously transporting said stack at a speed varying in response to a control signal to said distributor means, a control system for furnishing said control signal comprising, in combination, sensor means mounted in proximity to said distributor means for sensing the position of the top of said stack and furnishing a first sensor output signal when said top of said stack is correctly positioned relative to said sensor means, a second output signal when said position of said top of said stack is too low, and a third output signal when said position of said top of said stack is too high relative to said sensor means; first means for furnishing a desired speed signal corresponding at least in part to the speed of operation of said distributor means; and control means connected to said first means, said sensor means and said transport means for furnishing said control signal to said transport means in dependence upon said desired speed signal and the then present one of said first, second and third sensor output signals, wherein said first means comprise a generator driven at a speed corresponding to the operation of said distributor means and furnishing an output voltage varying as a function of said speed.

13. In a sheet feeder system having distributor means for distributing sheets for processing and having transport means for receiving a stack of sheets and continuously transporting said stack at a speed varying in response to a control signal to said distributor means, a control system for furnishing said contrl signal comprising, in combination, sensor means mounted in proximity to said distributor means for sensing the position of the top of said stack and furnishing a first sensor output signal when said top of said stack is correctly positioned relative to said sensor means, a second output signal when said position of said top of said stack is too low, and a third output signal when said position of said top of said stack is too high relative to said sensor means; first means for furnishing a desired speed signal corresponding at least in part to the speed of operation of said distributor means; and control means connected to said first means, said sensor means and said transport means for furnishing said control signal to said transport means in dependence upon said desired speed signal and the then present one of said first, second and third sensor output signals, wherein said sensor means comprise a feeler resting on top of said stack, first and second input signal furnishing means mounted in a first and second predetermined position relative to said feeler for furnishing a first and second input signal respectively, and disrupt means mechanically coupled to said feeler for movement therewith and mounted relative to said first and second input signal furnishing means in such a manner that said disrupt means interrupts the furnishing of said first, of both, or of neither of said input signal furnishing means in dependence upon the position of said top of said stack, wherein said first and second input signal furnishing means comprise, respectively, a first and second coil and means for inductively inducing a voltage in said first and second coil; and wherein said disrupt means comprise a mechanical member for interrupting the magnetic coupling to said coils in dependence upon the position of said top of said stack relative to said distributing means.

14. In a sheet feeder system having distributor means for distributing sheets for processing and having transport means for receiving a stack of sheets and continuously transporting said stack at a speed varying in response to a control signal to said distributor means, a control system for furnishing said control signal comprising, in combination, sensor means mounted in proximity to said distributor means for sensing the position of the top of said stack and furnishing a first sensor output signal when said top of said stack is correctly positioned relative to said sensor means, a second output signal when said position of said top of said stack is too low, and a third output signal when said position of said top of said stack is too high relative to said sensor means, first means for furnishing a desired speed signal corresponding at least in part to the speed of operation of said distributor means; and control means connected to said first means, said sensor means and said transport means for furnishing said control signal to said transport means in dependence upon said desired speed signal and the then present one of said first, second and third sensor output signals, wherein said transport means comprise first support means for supporting said stack, first moving means for moving said first support means and therefore said stack along a predetermined path towards said distributor means, second support means positioned along said predetermined path and having an opening for permitting passage of said stack, means for blocking said opening when the bottom of said stack has passed said second support means, second moving means for moving said second support means along a predetermined path towards said distributor means, and switch means mounted along said predetermined path of said first support means and mounted in said second support means for jointly controlling the application of said speed control signal to the operative one of said first or second moving means, wherein said first and second moving means respectively comprise a first and second DC motor, each of said DC motors having a separately excited field winding, and first and second drive means respectively interconnected between said first and second DC motor and said first and second support means.

15. A system as set forth in claim 14, wherein said transport means further comprise initial moving means for rapidly moving said first support means from a first predetermined position whereat said stack is received to a second predetermined position, and an electrically controlled multiple disc clutch interconnected between said first DC motor and said initial moving means for switching said first drive means from said initial moving means to said first DC motor under control of a clutch control signal; further comprising additional sensor means for furnishing said clutch control signal when said first transport means reaches said second predetermined position.

16. A system as set forth in claim 15, wherein said additional sensor means comprise an optical sensor furnishing said clutch control signal when said top of said stack reaches a position corresponding to said second predetermined position of said first support means.

* * * * *